US006332757B1

(12) United States Patent
Kaneko et al.

(10) Patent No.: US 6,332,757 B1
(45) Date of Patent: Dec. 25, 2001

(54) CONTROL VALVE FOR VARIABLE DISPLACEMENT COMPRESSOR

(75) Inventors: Morio Kaneko; Ichiro Ohkawara, both of Saitama; Masaki Ota, Aichi; Ken Suitou, Aichi; Kenta Nishimura, Aichi; Taku Adaniya, Aichi, all of (JP)

(73) Assignees: Kabushiki Kaisha Saginomiya Seisakusho, Tokyo; Kabushiki Kaisha Toyoda Jidoshokki Seisakusho, Aichi, both of (JP)

( * ) Notice: Subject to any disclaimer, the term of this patent is extended or adjusted under 35 U.S.C. 154(b) by 0 days.

(21) Appl. No.: 09/565,127

(22) Filed: May 4, 2000

(30) Foreign Application Priority Data

May 10, 1999 (JP) ..... 11-128362

(51) Int. Cl.[7] ..... F04B 1/26
(52) U.S. Cl. ..... 417/222.2; 417/222; 417/270
(58) Field of Search ..... 417/222.2, 222, 417/270

(56) References Cited

U.S. PATENT DOCUMENTS

| | | | | |
|---|---|---|---|---|
| 4,747,753 | * | 5/1988 | Taguchi | 417/222 |
| 5,607,286 | | 3/1997 | Takenaka et al. . | |
| 6,192,699 | * | 2/2001 | Kato et al. | 62/228.3 |

FOREIGN PATENT DOCUMENTS

| | | |
|---|---|---|
| 0258680 | 3/1988 | (EP) . |
| 0748936 | 12/1996 | (EP) . |
| 62-91672 | 4/1987 | (JP) . |
| 3-53474 | 8/1991 | (JP) . |
| 6-17010 | 5/1994 | (JP) . |
| 8-177735 | 7/1996 | (JP) . |

* cited by examiner

*Primary Examiner*—Charles G. Freay
*Assistant Examiner*—E D Hayes
(74) *Attorney, Agent, or Firm*—McDermott, Will & Emery

(57) ABSTRACT

A valve housing has a communication passage communicating a suction port of the compressor with a crank chamber of the compressor. A valve element opens and closes the communication passage, and a spring member resiliently biases the valve element toward the closed position. A pressure actuated unit moves the valve element toward the open position by a suction pressure of the compressor. The spring member includes a spring made of a temperature responsive material. The spring decreases in its resilient force in an opening direction of the valve element with increase of an outer-air temperature. The spring member has a primary spring made of an ordinary resilient material for resiliently biasing the valve element toward the closed position and a correction spring made of a material having a temperature positive characteristic. The correction spring provides a correction spring force smaller than a primary force of the primary spring in the opposite direction to the primary force. The combined spring force of the primary spring and the correction spring acting on the valve element.

6 Claims, 3 Drawing Sheets

CONTROL VALVE FOR VARIABLE DISPLACEMENT COMPRESSOR

BACKGROUND OF THE INVENTION

1. Field of the Invention

The present invention relates to a control valve for a variable displacement compressor, particular to a displacement control valve for a swash-plate-type variable displacement compressor which is applied to an on-vehicle air-conditioning unit or the like.

2. Related Art

Known displacement control valves for a swash-plate-type variable displacement compressor are disclosed in Japan patent Laid-open No. H. 3-53474, Japan Utility Model Laid-open No. H. 6-17010, and Japan patent Application Laid-open No. H. 8-177735.

The swash-plate-type variable displacement compressor having a control valve basically decreases in discharge displacement with increase of a crank chamber pressure of the compressor and increases in the discharge displacement with the decrease of the pressure. The control valve opens and closes a communication passage communicating a suction port of the compressor with the crank chamber by using a valve element moving in response to a suction pressure of the compressor, thereby controlling the pressure of the crank chamber. Furthermore, the valve element of the control valve is moved toward the open position by the discharge pressure of the compressor to vary the opening-closing switching point of the valve element in response to the discharge pressure. Thus, the control valve controls the fluid delivery in relation to an outer-air condition (a related discharge pressure).

The known displacement control valve is constructed in a way to achieve its object. However, the control valve controls the displacement according to an outer-air condition (for example, a cooling condition). Thus, there should be provided a mechanism for applying the discharge pressure of the compressor to the valve element toward the open position such as an actuating rod, a high-pressure regulating chamber, and a passage for applying the discharge pressure of the compressor to the chamber.

The control valve is not sufficiently satisfied by users, because it is desired to provide a more reliable opening and closing operation of the valve element. Moreover, the control valve has an increased number of parts, requiring an increased man hour for assembling thereof. In addition, a passage configuration for conducting the suction and discharge pressures to related portions of the valve is complicated, limiting an easy arrangement on the body of the compressor.

SUMMARY OF THE INVENTION

In view of the above-described disadvantages, an object of the invention is to provide a control valve of a variable displacement compressor for achieving a displacement control related to an outer-air state. The control valve has a simplified constitution and provides a reliable opening and closing operation of a valve element. The control valve does not cause an increase in number of parts and in assembling man-hour for thereof. In addition, the control valve is mounted in a compressor body and has a simple fluid passage, providing an unlimited arrangement on the compressor body.

For achieving the object, a first aspect of the invention is a control valve for variable displacement compressor which includes:

a valve housing having a communication passage communicating a suction port of the compressor with a crank chamber of the compressor, a valve element opening and closing the communication passage, a spring member resiliently biasing the valve element toward its closed position, and a pressure actuated unit for moving the valve element toward its open position by a suction pressure of the compressor.

The spring member includes a spring made of a temperature responsive material, the spring decreasing in its resilient force in an opening direction of the valve element with increase of an outer-air temperature. The spring member may have a primary spring made of an ordinary resilient material for resiliently biasing the valve element toward the closed position and a correction spring made of a material having a temperature positive characteristic material. The correction spring provides a correction spring force smaller than a primary force of the primary spring in the opposite direction to the primary force. A combined spring force of the primary spring and the correction spring acts on the valve element. Preferably, the correction spring is made of a shape memory alloy.

Preferably, the valve housing is inserted in a recess formed in a body of the compressor to be secured thereto, and the valve housing has an end to which the pressure actuated unit is secured. The pressure actuated unit is positioned to extend externally from the recess. The pressure actuated unit accommodates the spring member therein.

Next, advantageous effects of the invention will be discussed.

The spring force of the spring for resiliently biasing the valve element toward the valve closing position decreases with increase of an-outer temperature. This enables a displacement control related to an environmental condition such as an outer temperature proportional to the compressor discharge pressure. This control valve requires neither an additional rod nor a specific pressure transferring passage, allowing a simple configuration with a reliable operation for opening and closing the valve. The control valve can be produced without increase in parts number and in assembling man-our thereof. In addition, the control valve is integrally attached to the compressor body, allowing a simplified passage configuration. Advantageously, the simplified configuration enables an easy arrangement of other equipment on the compressor body.

The combined spring force of the primary spring exerting a spring force in the valve closing direction and the correction spring giving a spring force in a canceling direction against the primary spring force (the primary spring force is larger than the correction spring force) acts on the valve element. The correction spring can be made of a typical temperature responsive material having a temperature positive characteristic.

The correction spring can be made of a typical shape-memory alloy (SMA) having a temperature positive property.

The correction spring assembled in the pressure actuated unit responds to an outer-temperature, allowing a displacement control related to the outer-air that is an environmental condition.

DETAILED DESCRIPTION OF THE PREFERRED EMBODIMENTS

Referring to the accompanied drawings, embodiments of the present invention will be discussed hereinafter.

Figure 1:
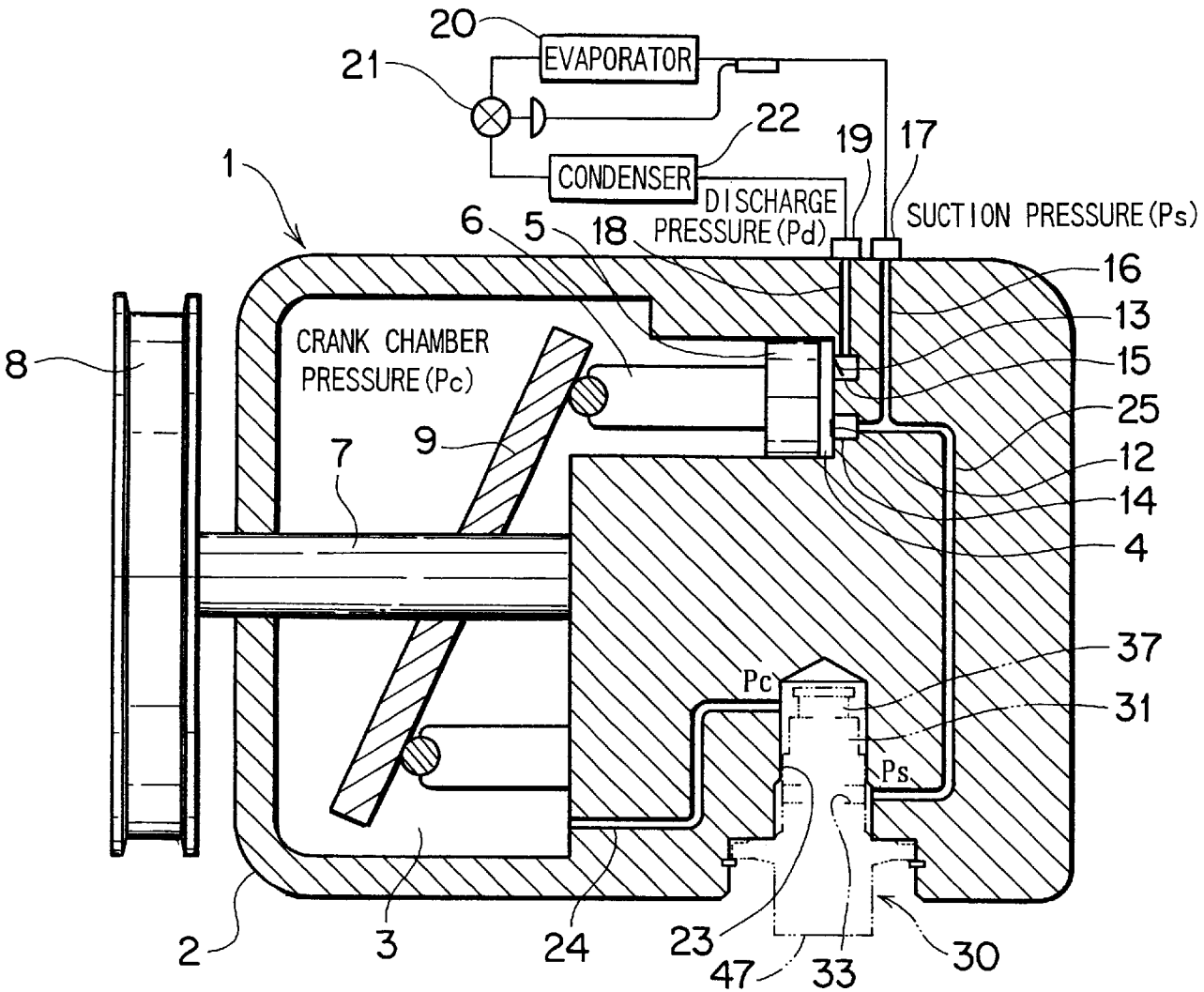
FIG. 1 is a sectional view showing an embodiment of a variable displacement compressor having a control valve according to the invention.
Figure 2:
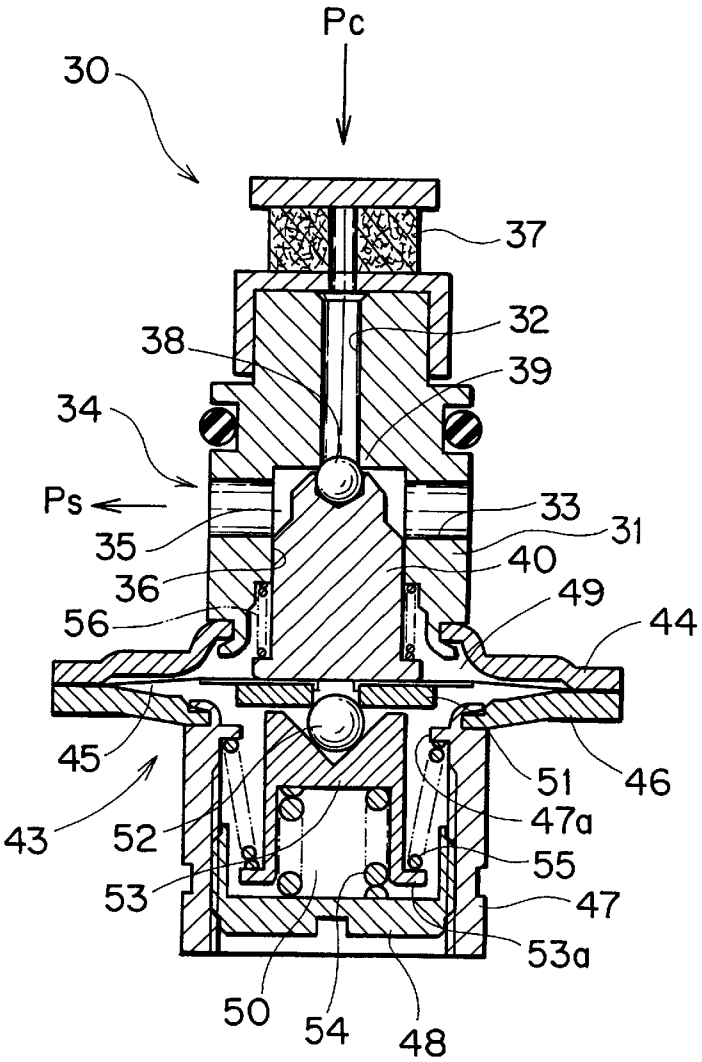
FIG. 2 is a sectional view showing an embodiment of a control valve according to the invention for a variable displacement compressor.

FIG. 1 shows a variable displacement compressor having a displacement control valve embodying the present invention. FIG. 2 shows the displacement control valve.

The variable displacement compressor 1 that is of a swash-plate type has a crank chamber 3 defined in a compressor body 2 and has a plurality of cylinder chambers 4 each communicating with the crank chamber 3 at a stroke end thereof. Each cylinder chamber 4 engages axially a slidable piston 5 that is coupled to an end of a piston rod 6 on the side defining the crank chamber 3.

The compressor housing 2 supports rotatively a drive shaft 7 which is rotated through a drive belt (not shown) coupled to a pulley 8 by an engine (not shown).

The drive shaft 7 is joined to a swash plate (inclined plate) 9 within the crank chamber 3 through a conventional connection link (not shown) to be able to vary the mounting angle of the swash plate 9. The swash plate 9 has a surface engaging with the piston rod 6 on the side defining the cylinder chamber 4 so as to exert a axial force of the piston rod 6.

The swash plate 9 that is in an inclined state is rotated through the drive shaft 7. Thereby, the piston 5 of each cylinder chamber 4 reciprocates with a stroke corresponding to an incline angle of the swash plate 9. The incline angle is automatically adjusted according to a difference between a pressure Pc in the crank chamber and a pressure in a suction pressure (a compressor suction pressure) Ps in each cylinder chamber 4.

The incline angle of the swash plate 9 decreases with increase of the crank chamber pressure Pc, which decreases the stroke of the piston 5. Thereby, the compressor 1 decreases in discharge capacity. On the contrary, the incline angle of the swash plate 9 increases with decrease of the crank chamber pressure Pc, which increases the stroke of the piston 5. Thereby, the compressor 1 increases in discharge capacity until the crank chamber pressure Pc becomes substantially equal to the suction pressure Ps to bring the compressor 1 in a full load state.

Each cylinder 4 has a suction port 14 with a one-way suction valve 12 and has a discharge port 15 with a discharge valve 13. The suction port 14 of each cylinder chamber 4 communicates with a suction connection port 17 through a suction passage 16. The discharge port 15 communicates with a discharge connection port 19 through a discharge passage 18. The suction connection port 17 and discharge connection port 19 communicates with a circulating line for a cooling cycle unit including an evaporator 20, an expansion valve 21, a condenser 22.

The compressor housing 2 has a valve recess 23 for receiving a control valve 30 according to the present invention to be secured thereto.

The control valve 30 has a cylindrical valve housing 31 mounted in the recess 23.

The valve housing 31 is formed with a T-shaped passage 34 consisting of a passage 32 communicating with the crank chamber and a passage 33 communicating with a suction port and has a valve stem receiving hole 36. The passage 32 is extending in a middle part of the valve housing 31 in an axial (vertical) direction of the valve housing 31 and is opened at one end face (upper face) of the valve housing 31. The passage 33 is extending across a middle part of the valve housing 31 in a radial direction of the valve housing 31. The valve stem receiving hole 36 communicates with a cross portion of the passage 32 and the passage 33 at one end thereof and is extending in a middle part of the valve housing 31 in an axial (vertical) direction of the valve housing 31 to be opened at the other end face (lower face) of the valve housing 31. The valve stem receiving hole 36 serves also as a valve chamber 35.

On the upper end face of the valve housing 31, there is mounted a filter 37 which overlays the open end of the passage 32 communicating with the crank chamber.

The valve chamber 35 includes a ball-shaped valve element 38. The ball-shaped valve element 38 selectively rests on a valve seat 39 in the valve housing 31 for opening and closing the commutation passage 34.

The receiving hole 36 receives a valve stem 40 slidable in the axial direction of the stem 40. The valve stem 40 engages with the ball valve element 38 at one end (upper end) thereof.

The housing 31 has the other end (lower end) which is positioned in the open side of the valve receiving recess 23. On the other end of the housing 31, there is mounted a diaphragm unit 43 as a pressure actuated unit that is externally exposed from the valve receiving recess 23 of the compressor body 2.

The diaphragm unit 43 has a saucer-shaped upper cover 44 snap-fitted on the other end of valve housing 31, a saucer-shaped lower cover 46 joined to the upper cover 44 with a diaphragm 45 sandwiched therebetween, a cylindrical spring accommodating case 47 snap-fitted on the lower cover 46, and an adjusting screw 48 screwed in the spring accommodating case.

The diaphragm 45 is joined to the other end (lower end) of the valve stem 40. In one side of the diaphragm 45, there is defined a diaphragm chamber 49 facing to the valve housing 31. In the other side of the diaphragm 45, there is defined a closed chamber 50 facing the spring case 47. The diaphragm 45 is coupled to the other end (lower end) of the valve stem 40 on the side providing the diaphragm chamber 49. The diaphragm chamber 49 communicates with the valve chamber 35 through a clearance (not shown) defined between the valve stem receiving hole 36 and the valve stem 40, thereby introducing the suction pressure Ps of the compressor 1 from the valve chamber 35 in the valve open direction.

On the side of the diaphragm 45 defining the closed chamber 50, there are sequentially disposed an abutment plate 51, a ball 52, and a spring retaining member 53. Between the spring retaining member 53 and the adjusting screw 48, there is arranged a primary spring 54 resiliently biasing the ball element 38 toward the valve closing position (upward) through the diaphragm 45 and the valve stem 40. The primary spring 54 is a compression coil spring made of a normal spring material substantially having no temperature responsive property such as a spring steel.

The spring case 47 and the spring retaining member 53 each have a correction-spring supporting flange 47*a* or 53*a*. Between the supporting flanges 47*a*, 53*a*, there is mounted a correction spring 55 which provides a force canceling the spring force of the primary spring 54.

Figure 3:
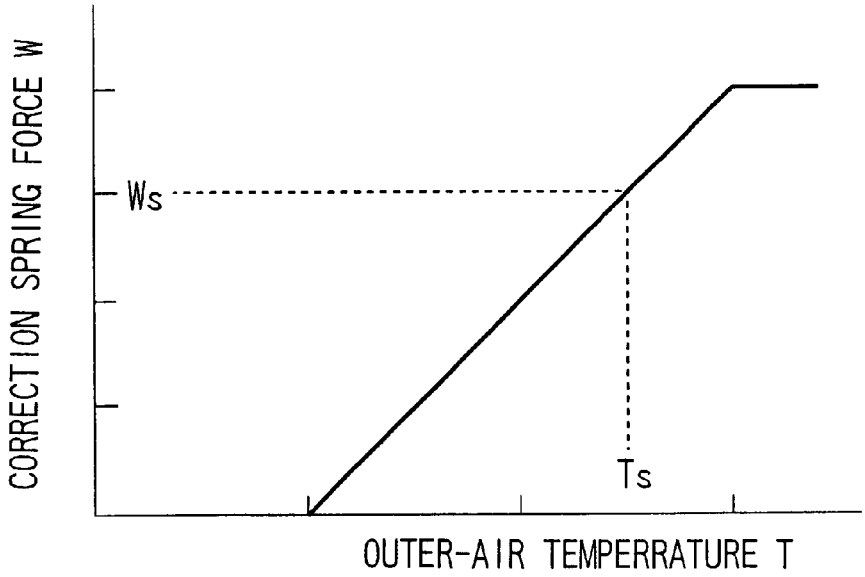
FIG. 3 is a graph showing a spring force varying according to an outer-temperature regarding a correction spring made of a temperature responsive material and used in the control valve of the variable displacement compressor according to the invention.

The correction spring 55 is made of a temperature responsive material having a temperature positive characteristic such as a shape memory alloy (SMA). The correction spring 55 positioned in the spring case 47 of the diagram unit 43 is responsive to an outer-air temperature T and has a correction spring force property related to an outer-air as illustrated in FIG. 3. Note that the maximum spring force of the correction spring 55 is determined to be smaller than the spring force of the primary spring 54. That is, the spring force of the primary spring 54 is always larger than that of the correction spring 55.

The correction force W of the correction spring 55 increases with increase of an outer-air temperature T. Thereby, the sum (valve closing force) of the spring forces of the primary spring 54 and the correction spring 55 decreases with increase of an outer-air temperature T.

In addition, between the valve stem 40 and the valve housing 31, there is provided an intermediate spring 56 that is a compression coil spring having a spring force significantly smaller than the above-mentioned sum of the spring forces.

Such constituted control valve 30 is inserted in and secured to the receiving recess 23 of the compressor body 2. The passage 32 communicates with the crank chamber 3 through a crank chamber pressure delivering passage 24 which is opened to a bottom portion of the receiving recess 23. The passage 33 communicates with the suction port 14 through a passage 25 for being exposed to a suction pressure of the compressor. The passages 24, 25 are formed in the compressor housing 2 for transferring a pressure of the crank chamber or the suction port.

Next, an operation of such configured displacement control valve 30 will be discussed.

A suction pressure Ps of the compressor 1 is transferred to the diaphragm chamber 49 from the suction port 14 through the passage 25, the passage 33, and the passage 35 moving the ball valve element 38 toward the open position.

The ball valve element 38 opens and closes according to the suction pressure Ps acting on the diaphragm 45 toward the valve open position and according to the valve closing force exerted by the primary and correction springs 54, 55. Note that the weak spring force of the intermediate spring 56 is neglected because of almost no effect on the control characteristic of the control valve.

Thus, when the suction pressure Ps becomes smaller than a set pressure (a reference pressure Pss) corresponding to the total spring force of the primary and correction springs 54, 55, the total spring force moves the diaphragm 45 upward as illustrated in FIGS. 1, 2, so that the ball valve element 38 moves toward the closed position through the valve stem 40 to abut against the valve seat 39 to close the valve.

This prevents the suction pressure Ps from being transferred to the crank chamber 3, increasing the crank chamber pressure Pc so that the compressor 1 becomes in an unload operation.

Meanwhile, when the suction pressure Ps becomes larger than a predetermined pressure (reference pressure Pss), the diagram 45 moves downward (FIGS. 1, 2) against the combined spring force of the primary and correction springs 54, 55. Thereby, the ball valve element 4) moves apart from the valve seat 39 toward the open position.

Thus, the crank chamber 3 is provided with a suction pressure Ps until the crank chamber pressure Pc become equal to the suction pressure Ps as that the compressor 1 reach a full load operation state.

Figure 4:
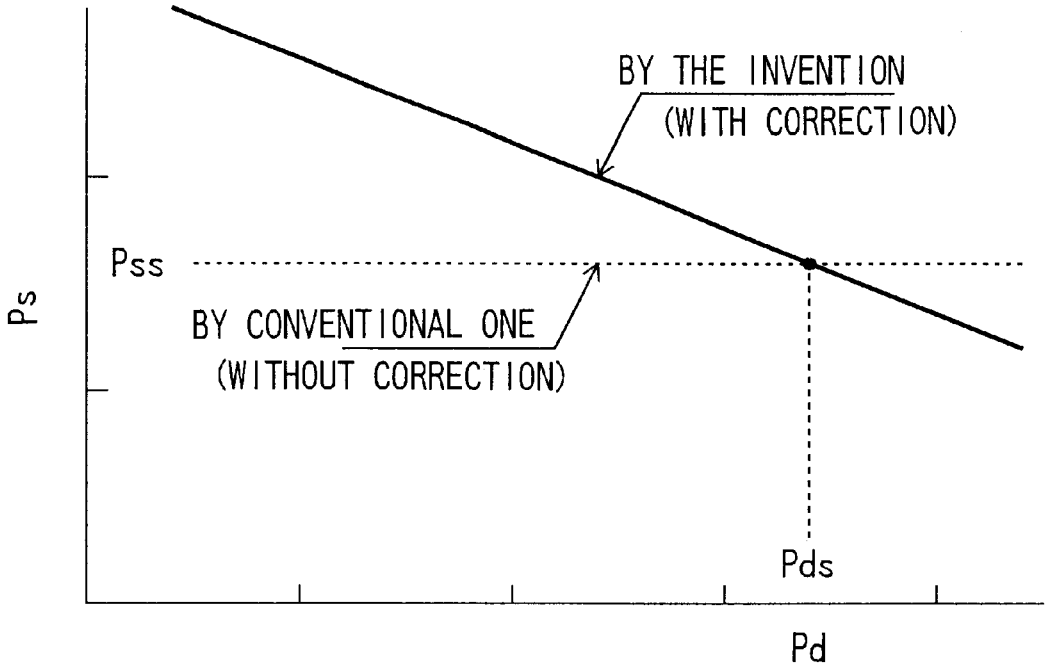
FIG. 4 is a graph showing a specific relation between a discharge pressure and a suction pressure regarding the control valve of the variable displacement compressor according to the invention.

As described above, if the combined spring force exerted toward the valve closed position is constant, that is, if the spring forces do not vary with the environmental condition, the compressor 1 carries out a displacement controlled operation with the suction pressure Ps being constant to be equal to the reference pressure Pss as illustrated by a dotted line in FIG. 4.

The combined spring force of the primary and correction spring 54, 55 decreases with increase of an outer-air temperature T, since the correction spring 55 increases in its spring force W with increase of temperature T. Thus, the suction pressure Ps for opening the valve increases with decrease of an outer-air temperature T, while the suction pressure Ps for opening the valve decreases with increase of an outer-air temperature T.

An outer-air temperature T is denoted as Ts when a reference discharge pressure is Pds; a spring force W of the correction spring is denoted as Ws when an outer-air temperature is Ts; and an effective pressure exerting area is denoted as Ad. When the outer-air temperature T becomes lower than Ts, the valve closing force increases to be larger than the reference spring force by Ws–W so that the valve opening pressure increases by (Ws–W)/Ad. Meanwhile, when the outer-air temperature T becomes higher than Ts, the valve closing force decreases to be smaller than the reference spring force by W–Ws so that the valve opening pressure decreases by (W–Ws)/Ad.

The following formula shows this pressure responsive characteristic.

$$Ps=Pss-(W-Ws)/Ad$$

Thereby, as illustrated by a solid line in FIG. 4, a specified control in which the suction pressure Ps decreases proportionally to the increase of the outer-air temperature T is obtained. Thus, the displacement control compressor can have a control characteristic according to an outer-air temperature T (or the discharge pressure Pd) relating to a load of a system including the compressor.

This allows a compressor displacement control which is effective to be saved in energy in a cooling medium circuit system in which an evaporation load is proportional to a condensation load, the evaporation load is proportional to a cooling medium circulation flow rate, and a pressure loss in an evaporator is proportional to the medium circulation flow rate.

In the embodiment, the pressure actuated unit is a diaphragm unit 43. Alternatively, the diaphragm unit may be a closed bellows or the like.

Figure 5:
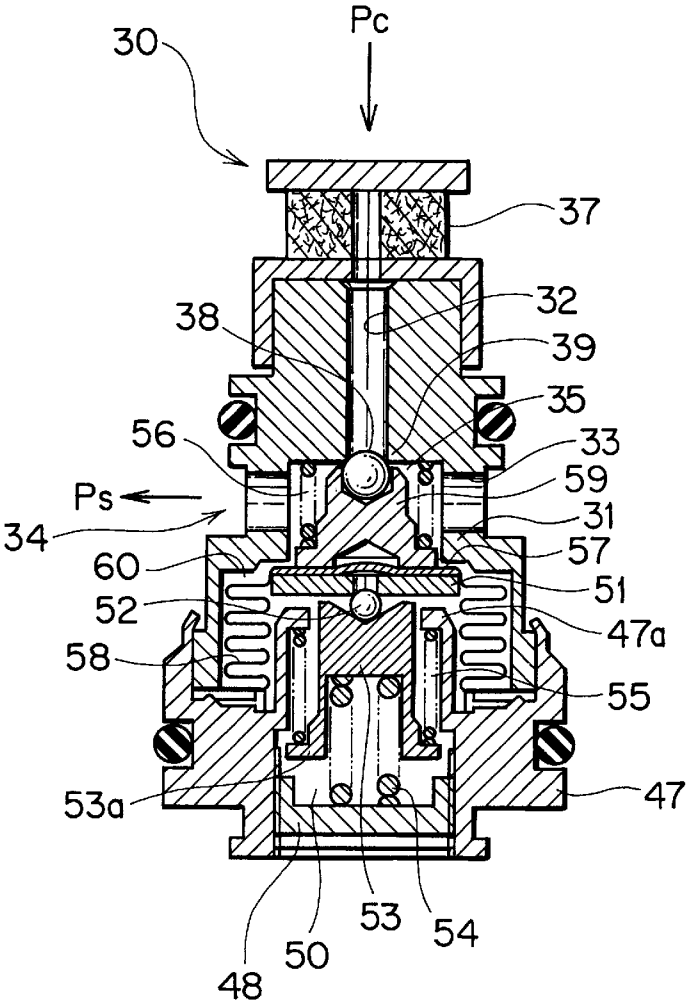
FIG. 5 is a sectional view showing another embodiment of a control valve for a variable displacement compressor according to the invention.

Referring to FIG. 5, a control valve for a variable displacement compressor, which has a closed bellows constituting a pressure actuated unit, will be discussed. In FIG. 5, the same element as described of FIG. 2 has the same reference numeral as described in FIG. 2 and will not be discussed again.

In this embodiment, a valve housing 31 is provided with a bellows 58 unitarily having an end plate 57. The bellows

58 defines a closed chamber 50 therein. The bellows 58 connects to a retainer 59 for a bail-type valve element 38 through the end plate 57.

The bellows 58 has an outer chamber 60 communicating with a valve chamber 35. The bellows 58 receives a suction pressure Ps transferred from the valve chamber 35 to a bellows accommodation case 68. The pressure Ps acts to move the valve element toward the open position. The bellows 58 expands and contracts according to the differential pressure between the suction pressure Ps and the bellows inside pressure.

This embodiment also includes a correction spring 55 made of a material having a temperature positive characteristic, achieving an effective operation similar to the first described embodiment.

What is claimed is:

1. A control valve for a variable displacement compressor comprising:

a valve housing having a communication passage communicating a suction port of the compressor with a crank chamber of said compressor, a valve element opening and closing said communication passage, a spring member resiliently biasing said valve element toward its closed position, and a pressure actuated unit for moving said valve element toward its open position by receiving a suction pressure of said compressor, wherein said spring member includes a spring made of a temperature responsive material, said spring decreasing in its resilient force in a closing direction of said valve element with increase of an outer-air temperature.

2. The control valve set forth in claim 1 wherein said spring member has a primary spring made of a spring material for resiliently biasing said valve element toward its closed position and a correction spring made of a material having a temperature positive characteristics, said correction spring providing a correction spring force smaller than a primary force of the primary spring in the opposite direction to the primary force, a combined spring force of said primary spring and said correction spring acting on said valve element.

3. The control valve set forth in claim 2 wherein said correction spring is made of a shape memory alloy.

4. The control valve set forth in claim 1 wherein said valve housing is inserted in a recess formed in a body of said compressor to be secured thereto, and said valve housing has an end to which said pressure actuated unit is secured, said pressure actuated unit being positioned to extend externally from said recess, said pressure actuated unit accommodating said spring member therein.

5. The control valve set forth as in claim 2, wherein said valve housing is inserted in a recess formed in a body of said compressor to be secured thereto, and said valve housing has an end to which said pressure actuated unit is secured, said pressure actuated unit being positioned to extend externally from said recess, said pressure actuated unit accommodating said spring member therein.

6. The control valve set forth as in claim 3, wherein said valve housing is inserted in a recess formed in a body of said compressor to be secured thereto, and said valve housing has an end to which said pressure actuated unit is secured, said pressure actuated unit being positioned to extend externally from said recess, said pressure actuated unit accommodating said spring member therein.

* * * * *